US010051940B2

(12) United States Patent
Brugger

(10) Patent No.: US 10,051,940 B2
(45) Date of Patent: Aug. 21, 2018

(54) APPLICATION DISPENSER FOR AT LEAST ONE COMPONENT

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 8 days.

(21) Appl. No.: 14/889,342

(22) PCT Filed: May 5, 2014

(86) PCT No.: PCT/EP2014/001191
§ 371 (c)(1),
(2) Date: Nov. 5, 2015

(87) PCT Pub. No.: WO2014/180555
PCT Pub. Date: Nov. 13, 2014

(65) Prior Publication Data

US 2016/0081452 A1 Mar. 24, 2016

(30) Foreign Application Priority Data

May 6, 2013 (DE) ..... 20 2013 004 144 U

(51) Int. Cl.

| | |
|---|---|
| ***A45D 34/04*** | (2006.01) |
| ***B01F 5/06*** | (2006.01) |
| ***B01F 13/00*** | (2006.01) |
| ***B01F 15/00*** | (2006.01) |
| ***B01F 15/04*** | (2006.01) |

(Continued)

(52) U.S. Cl.
CPC ..... *A45D 34/041* (2013.01); *A45D 40/24* (2013.01); *B01F 5/0666* (2013.01); *B01F 13/0023* (2013.01); *B01F 15/0087* (2013.01); *B01F 15/0416* (2013.01); *B05B 11/3083* (2013.01); *B05B 11/3084* (2013.01); *A45D 2200/056* (2013.01); *A45D 2200/058* (2013.01); *B05B 11/0037* (2013.01); *B05B 11/0064* (2013.01); *B05B 11/3004* (2013.01)

(58) Field of Classification Search
CPC ..... B01F 5/0666; B05C 9/06; B05C 17/0341; B43M 11/02; A45D 34/041; A45D 40/261; A45D 2200/058
USPC ..... 401/209, 216
See application file for complete search history.

(56) References Cited

U.S. PATENT DOCUMENTS

| | | | | |
|---|---|---|---|---|
| 2,968,826 A * | 1/1961 | Leshin | ..... | A45D 34/041 401/209 |
| 6,533,482 B1 * | 3/2003 | Byun | ..... | A45D 34/04 222/321.7 |
| 7,153,053 B1 | 12/2006 | Wiley | | |

(Continued)

FOREIGN PATENT DOCUMENTS

| | | |
|---|---|---|
| DE | 20 2004 007 598 | 8/2004 |
| WO | 2013025767 | 2/2013 |

OTHER PUBLICATIONS

European Patent Office, International Search Report, dated Jul. 28, 2014.

*Primary Examiner* — Jennifer C Chiang
*Assistant Examiner* — Bradley Oliver
(74) *Attorney, Agent, or Firm* — Price Heneveld LLP

(57) ABSTRACT

An application dispenser for at least one component, in particular for an adjustable dosing and/or mixing dispenser, includes a rotation element, in particular a ball for applying the at least one component, and a pump configured to load the at least one component with pressure and feed the at least one component under pressure onto the rotation element.

10 Claims, 3 Drawing Sheets

(51) Int. Cl.
*A45D 40/24* (2006.01)
*B05B 11/00* (2006.01)

(56) References Cited

U.S. PATENT DOCUMENTS

| | | | | |
|---|---|---|---|---|
| 2008/0107475 | A1 | 5/2008 | Wojcik | |
| 2013/0056020 | A1* | 3/2013 | Wilson | A45D 34/041 132/320 |
| 2013/0144225 | A1* | 6/2013 | Rowen | A61M 35/003 604/290 |

* cited by examiner

APPLICATION DISPENSER FOR AT LEAST ONE COMPONENT

BACKGROUND OF THE INVENTION

The invention relates to an application dispenser for at least one component, in particular for an adjustable dosing and/or mixing dispenser.

Application dispensers of this type are typically used for cosmetic products, e.g. lipsticks into which a personal care component is mixed. For this purpose so far static mixers are typically used where the components are inserted into a coiled tube and thus mixed. Thus, however, it is disadvantageous that a substantial residual volume remains in the mixer, thus plural strokes at the dosing dispenser are required for example when the dosing ratio changes in order to eventually reach the desired mixing ratio. Since components of this type can be very expensive it is desirable that this disadvantage is substantially avoided. Furthermore the mix can cure in the static mixer or become inactive so that the mixer has to be replaced or the mix of the components is not useable any more.

Furthermore mixing heads or so called applicators are known in which the outlet openings are configured needle shaped, wherein an outlet nozzle for a component is enveloped by an annular gap through which the second component exits in order to be mixed with the adjacent component. Producing applicators of this type, however, is rather complex due to the complicated tool configuration. DE 101 56 531 B4 furthermore describes a deodorant roller which includes a typical rotation element, in particular configured as a ball for applying the component or the liquid substance. Thus, also an intermediary liquid dispenser below the sphere is described in order to wet the sphere and in order to obtain better response during use, thus to prevent a drying of the sphere. For oily or pasty substances that are typically used for personal care products or glues the feed effect, however, is insufficient.

Thus, it is an object of the invention to provide an application dispenser for at least one component, wherein the disadvantages recited supra are avoided, in particular a defined feeding of the component and a better mixing of two components is provided.

SUMMARY OF THE INVENTION

The proposed feeding of the component under pressure loading through a pump reliably wets the rotation element, in particular the ball, even when substances have higher viscosity. Thus, for the generally used ball the surface portion arranged in the socket, thus a little more than the lower sphere is safely wetted by the component so that the component is applied already for a rather small amount of rotation of the ball.

Thus, the rotation element acts as a deflection element for the component coming from the pump outlet under pressure, so that the gap cavity below the ball is reliably filled so that the component can be quickly applied like in a deodorant roller. The pump which typically has a suction valve at the inlet and a check valve at the outlet furthermore blocks a path to the container of the component so that drying out can be safely prevented.

Additional advantages can be derived in the advantageous embodiment with two components and two pumps configured as a dosing and/or mix dispenser. Thus, the common rotation element is advantageously supported in a socket so that a tub shaped intermediary storage cavity is formed in the lower portion of the sphere. The pump volume of the pump is thus advantageously configured so that it corresponds to the volume of the intermediary storage device. It is furthermore useful that the rotation element is supported at ribs in the socket forming capillary gaps. This prevents an overload of the pump and furthermore causes a small amount of feeding beyond the "equatorial plane" of the sphere so that the upper portion of the sphere can also be wetted in order to obtain a quick application.

In order to achieve simple fabrication of the application dispenser the rotation element is advantageously pressed into the socket precisely fitting so that the socket can be integrally produced in one piece, in particular as an injection molded component.

In the advantageous embodiment as a mix dispenser at least two feed channels for at least two components are provided below the rotation element, in particular in the portion of the intermediary storage device. The two components are aligned in the axial direction of the application dispenser and can thus be produced in a simple manner. Furthermore the feed channels can include additional subdivisions, in particular provided by bars which can be produced in a rather simple manner through injection molding. These subdivisions can also extend in a meandering, undulated or zig zag shape as it is known from DE 20 2011002 558.

It is advantageous for the recited configuration of a mix dispenser that the feed channels are divided from each other through an intermediary wall up to the rotation element so that intermediary reactions cannot occur. The plurality individual channels thus formed joins the two or more components at the rotation element, thus intensively mixing them since the individual outlet openings are only apart from each other in a millimeter range so that the pressure loading towards the rotation element can help to obtain comprehensive mixing. Completely dividing the components up to the outlet location leaves no residual volume of mixed components or only a very small residual volume of the mixed components.

Advantageously the outlet openings are connected with separate ring cavities which are in turn connected with separate feed channels. Furthermore the ring cavities are advantageously closed with a center plug or a precisely fitting ring during production so that fabrication complexity is reduced. In order to obtain cost effective production the intermediary wall is advantageously integrally formed in one piece with the housing of the application dispenser, in particular formed as an injection molded component. By the same token the feed channels for the components can be integrally produced with the housing in an injection molded component.

BRIEF DESCRIPTION OF THE DRAWINGS

Subsequently an embodiment of the application dispenser is described in more detail with reference to the drawing figure, wherein.

DETAILED DESCRIPTION OF THE PREFERRED EMBODIMENTS

Figure 1B:
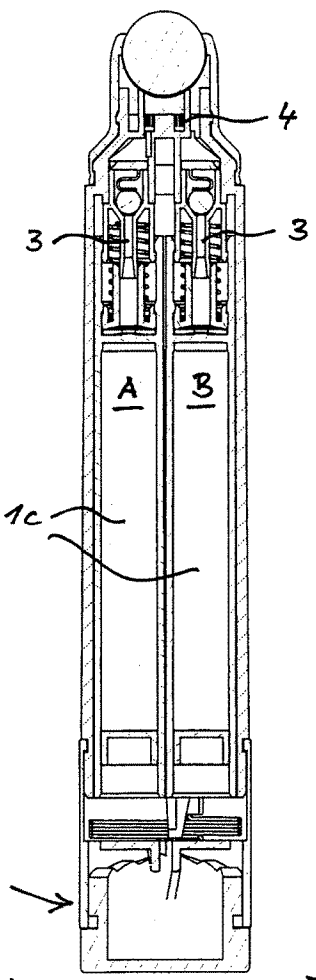
FIG. 1 illustrates a view of an application dispenser with two cross sections (1A, 1B) rotated relative to each other by 90°.
Figure 1A:
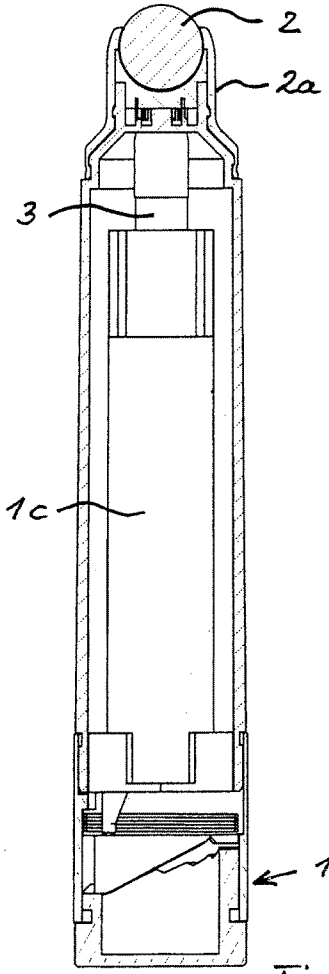
Figure 1:
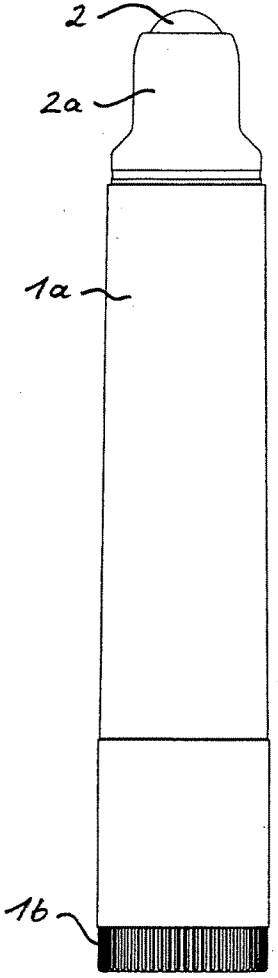

FIG. 1 illustrates an application dispenser 1 configured as a cylindrical pin. This application dispenser includes a rotation element 2 on top, in particular configured as a ball in order to facilitate applying at least one component, for example for lipsticks or similar cosmetic articles that include two or more components. The rotation element 2 thus protrudes beyond a socket 2*a* which is applied to the housing 1*a* of the application dispenser 1. An adjustment device 1*b* configured as a turn button is provided at a bottom of the housing 1*a* wherein a volume ratio of the two components is adjustable by wedge elements (c.f. FIG. 1A and FIG. 1B). This adjustment device is described in more detail in the application DE 20 2012 006 466.5 of the applicant so that additional explanations can be omitted.

Figure 4:
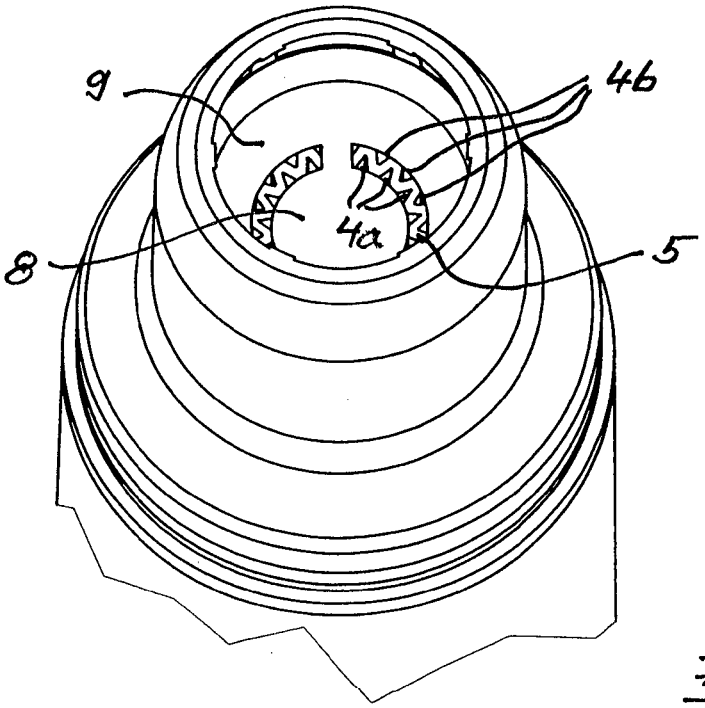
FIG. 4 illustrates a perspective view according to FIG. 3 with an intermediary wall.

The components are fed from schematically illustrated cartridges 1*c* (c.f. in particular FIG. 1B) to the rotation element 2 by a respective pump 3, wherein the two components (A and B) are transported separately through two feed channels 4. Additionally a plurality of outlet openings is arranged proximal to the rotation element 2 (c.f. FIG. 4), wherein the outlet openings for the component A are designated as 4*a*, whereas the outlet openings for the component B are designated with the reference numeral 4*b*. The outlet openings 4*a, b* that are offset from each other are thus divided by an intermediary wall 5.

FIG. 1B illustrates the arrangement of the cartridges 1*c* or containers for the two components A and B and the two pumps 3. FIG. 2B illustrates the upper portion enlarged, wherein the component A is run through the central feed channel 4 within the intermediary wall 5, whereas the component B moves to an annular cavity 6 so that it exits under pressure at the rotation element 2 along an outside of the intermediary wall 5. The component A thus exits at a plurality of outlet openings 4*a* at an inside of the intermediary wall 5 and the component B exits at a respective number of outlet openings 4*b* at a radially outer side of the intermediary wall 5 (c.f. FIG. 4).

This yields an intense mixing of the components directly at the rotation element 2. The divided feed channels 4*a*, 4*b* are enveloped by a central plug 8 or a ring 9 so that the two components can only exit along the fine individual channels directly onto the rotation element 2.

FIG. 1A illustrates only one cartridge 1*c* and one pump 3 in a sectional view of the application dispenser 1 that is rotated by 90° relative to FIG. 1B. For this basic configuration with only one pump 3 for only one component the invention can be used as well since pressure loaded wetting of the rotation element 2 provides significant advantages for the "response" of the dispenser. In particular the material to be applied is provided with the actuation of the pump in the "equator portion" of the sphere 2 in order to be immediately applied by a slight rotation of the sphere 2.

Figure 2A:
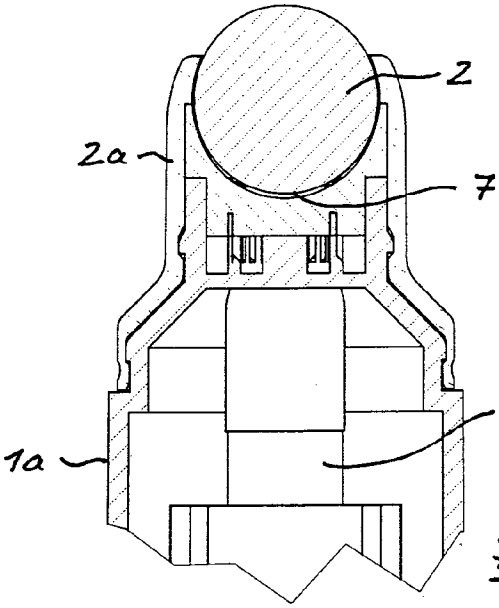
FIGS. 2A and 2B illustrate two enlarged details according to FIG. 1A and FIG. 1B and two views of a socket of the application dispenser (2C and 2D)
Figure 2B:
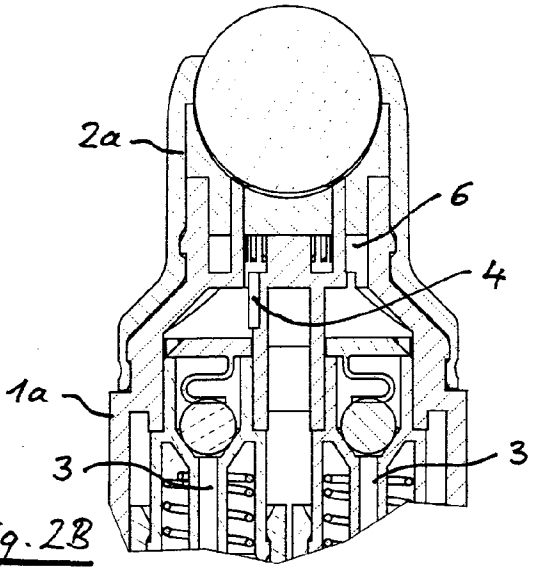
Figure 3:
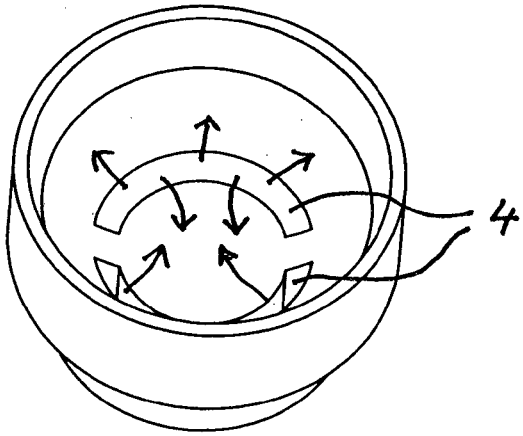
FIG. 3 illustrates an enlarged perspective view of two feed channels.

FIG. 2A illustrates the upper portion according to FIG. 1 in an enlarged manner, wherein the rotation element 2 is moved upward slightly through the pressure loading and thus forms an intermediary storage 7 below the ball. Thus, the "gap" is the largest at the lowest point, so that the product flow from the feed channels occurs in opposite directions for two components (c.f. FIG. 3). This additionally increases the mix effect together with the pressure loading.

Figure 2C:
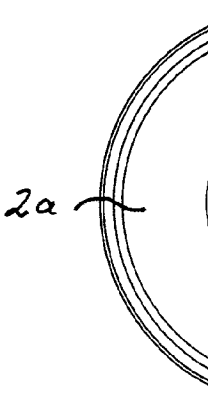
Figure 2D:
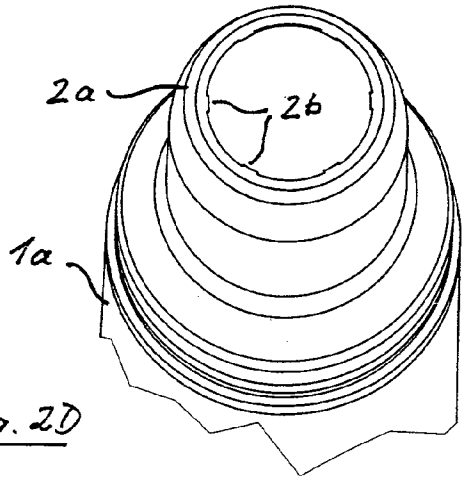

FIG. 2C illustrates a top view of the socket 2*a* without the rotation element 2. Thus, six ribs 2*b* are integrally formed in the interior (c.f. also the corresponding perspective in FIG. 2D) in order to form tight capillary gaps that are defined towards the spherical surface. This prevents overloading of the pump 3, wherein the minor exit of the pumped in components (–n) beyond the socket 2*a*, but adhering at the sphere even improves response properties.

FIG. 3 illustrates a bottom element of the socket 2*a* separately, wherein the feed channels 4 for the two components are visible. The feed channels 4 for the components A, B can be produced integrally in one piece with the socket 2*a*, in particular as an injection molded component. The feed channels 4 can also include bars or subdivisions in order to further divide product flow which is indicated by arrows. It is thus essential that the product flow in a center of the intermediary storage device 7 occurs in opposite directions which increases mixing. This applies in particular for the embodiment with the intermediary wall 5 which is visible quite well in the perspective view in FIG. 4 in order to form the outlet openings 4*a* and 4*b* recited supra and in order to provide intensive mixing.

The invention claimed is:

1. An application dispenser for at least one component, comprising:

a rotation element including a ball for applying the at least one component; and at least one pump configured to load the at least one component with pressure and feed the at least one component under pressure onto the rotation element;

wherein a socket is configured to fit with the ball such that the ball precisely fits in the socket;

wherein the ball is supported in the socket such that the ball is moved upward under pressure load of the at least one pump thus forming a tub shaped intermediate storage device below the ball;

wherein the intermediate storage device includes a sickle shaped gap wherein the gap is largest at a lowest point of the gap;

wherein the at least one component includes at least two components, and wherein at least two supply channels for the at least two components are located below the rotation element; and wherein a pump volume of the at last one pump corresponds to a volume of the tub shaped intermediate storage device.

2. The application dispenser according to claim 1, wherein the at least one component includes two components, and wherein the at least one pump includes two pumps.

3. The application dispenser according to claim 1, wherein the rotation element is supported by ribs in a socket and forms capillary gaps.

4. The application dispenser according to claim 1, wherein the socket is pressed in at the rotation element.

5. The application dispenser according to claim 4, wherein the socket is integral with a plug and a ring.

6. The application dispenser according to claim 5, wherein the socket, the plug and the ring are injection molded.

7. The application dispenser according to claim 1, wherein the at least two supply channels include subdivisions which extend at least one of a meander shape, a wave shape, and a zig zag shape.

8. The application dispenser according to claim 1, wherein the at least two supply channels for the at least two components are separated from each other by a divider wall up to the rotation element.

9. The application dispenser according to claim 1, wherein the at least one pump includes a suction valve at an inlet and a check valve at an outlet.

10. An application dispenser for at least one component, comprising:

a rotation element including a ball for applying the at least one component; and at least one pump configured to lead the at least one component with pressure and feed the at least one component under pressure onto the rotation element;

wherein the at least one component includes at least two components, and wherein at least two supply channels for the at least two components are located below the rotation element; and wherein the at least two supply channels are connected with separate annular cavities which are closed by at least one of a center plug and a ring.

* * * * *